United States Patent [19]

Satoh et al.

[11] Patent Number: 5,038,659

[45] Date of Patent: Aug. 13, 1991

[54] MUSICAL SCORE BLOCK COPY FORMING APPARATUS

[75] Inventors: Kohya Satoh; Haruo Mutoh; Masanori Hosoya, all of Tokyo, Japan

[73] Assignee: Toppan Printing Co., Ltd., Tokyo, Japan

[21] Appl. No.: 345,701

[22] PCT Filed: Aug. 18, 1988

[86] PCT No.: PCT/JP88/00816

§ 371 Date: Apr. 18, 1989

§ 102(e) Date: Apr. 18, 1989

[87] PCT Pub. No.: WO89/01651

PCT Pub. Date: Feb. 23, 1989

[30] Foreign Application Priority Data

| | | | |
|---|---|---|---|
| Aug. 18, 1987 | [JP] | Japan | 62-204449 |
| Aug. 18, 1987 | [JP] | Japan | 62-204450 |
| Aug. 26, 1987 | [JP] | Japan | 62-212131 |
| Nov. 6, 1987 | [JP] | Japan | 62-280744 |

[51] Int. Cl.[5] ..... G10G 3/04

[52] U.S. Cl. ..... 84/462; 84/463; 84/475; 84/483.1; 400/117

[58] Field of Search ..... 84/461, 462, 463, 475, 84/483 R, 483 A, 484; 400/116, 117

[56] References Cited

U.S. PATENT DOCUMENTS

| | | | |
|---|---|---|---|
| 3,926,088 | 12/1975 | Davis et al. | 84/462 |
| 4,298,290 | 11/1981 | Barnes et al. | 400/3 |
| 4,506,587 | 3/1985 | Tanaka | 84/462 |
| 4,538,500 | 9/1985 | Kozuki et al. | 84/462 |
| 4,790,230 | 12/1988 | Sanderson | 84/462 |

FOREIGN PATENT DOCUMENTS

| | | |
|---|---|---|
| 0053393 | 6/1982 | European Pat. Off. . |
| 1337201 | 11/1973 | United Kingdom . |

*Primary Examiner*—Steven L. Stephan
*Assistant Examiner*—Emanuel Todd Voeltz
*Attorney, Agent, or Firm*—Bacon & Thomas

[57] ABSTRACT

A musical score block copy forming apparatus has a musical keyboard (1) having a full-scale key group and a chromatic-scale key group, and a function keyboard (2) having function keys, and the like. Data input at the keyboards (1, 2) and data necessary for a musical score forming arithmetic operation are stored in a storage unit (7). The input data and the data stored in the storage unit (7) are subjected to arithmetic processing by an arithmetic processing unit (3). The arithmetic processing unit (3) has a layout change function used when a musical score is formed, and can display a musical score on a display (4) on the basis of an arithmetic result. The musical score displayed on the display is output to an output unit (5) for forming a block copy of the musical score.

7 Claims, 21 Drawing Sheets

| NOTE VALUE | NOTE VALUE NUMBER |
|---|---|
| WHOLE NOTE | 64 |
| HALF NOTE | 32 |
| QUARTER NOTE | 16 |
| EIGHTH NOTE | 8 |
| SIXTEENTH NOTE | 4 |
| THIRTY-SECOND NOTE | 2 |
| SIXTY-FOURTH NOTE | 1 |

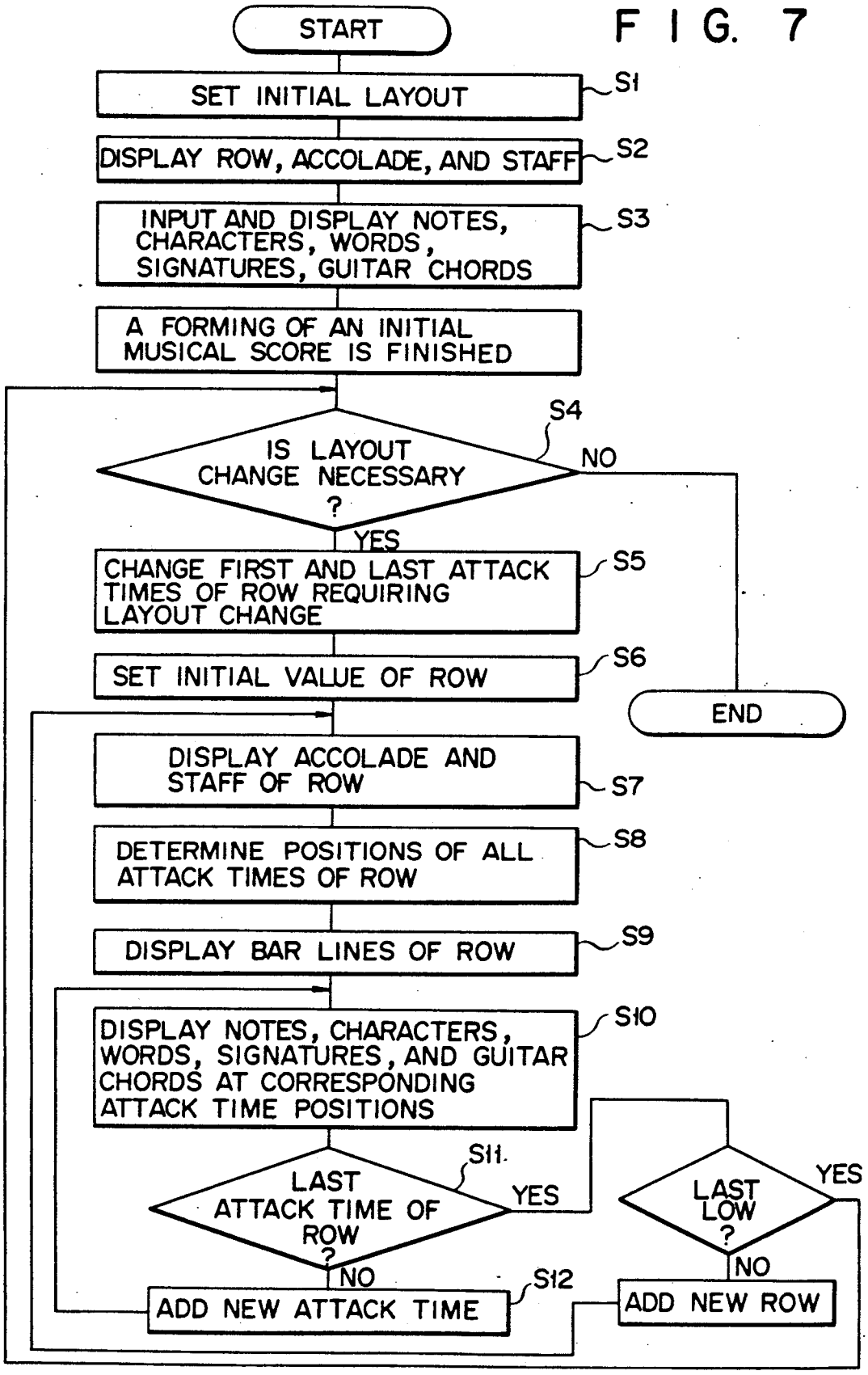
FIG. 7
START
SET INITIAL LAYOUT
S1
DISPLAY ROW, ACCOLADE, AND STAFF
S2
INPUT AND DISPLAY NOTES, CHARACTERS, WORDS, SIGNATURES, GUITAR CHORDS
S3
A FORMING OF AN INITIAL MUSICAL SCORE IS FINISHED
S4
IS LAYOUT CHANGE NECESSARY ?
NO
YES
CHANGE FIRST AND LAST ATTACK TIMES OF ROW REQUIRING LAYOUT CHANGE
S5
SET INITIAL VALUE OF ROW
S6
END
DISPLAY ACCOLADE AND STAFF OF ROW
S7
DETERMINE POSITIONS OF ALL ATTACK TIMES OF ROW
S8
DISPLAY BAR LINES OF ROW
S9
DISPLAY NOTES, CHARACTERS, WORDS, SIGNATURES, AND GUITAR CHORDS AT CORRESPONDING ATTACK TIME POSITIONS
S10
S11
LAST ATTACK TIME OF ROW ?
YES
NO
LAST LOW ?
YES
NO
S12
ADD NEW ATTACK TIME
ADD NEW ROW

| | | K | S | T | N | H | ---- |
|---|---|---|---|---|---|---|---|
| A | あ | か | さ | た | な | は | ---- |
| I | い | き | し | ち | に | ひ | |
| U | う | く | す | つ | ぬ | ふ | |
| ⋮ | ⋮ | ⋮ | ⋮ | ⋮ | ⋮ | ⋮ | |
| a | ア | カ | サ | タ | ナ | ハ | |
| i | イ | キ | シ | チ | ニ | ヒ | |
| ⋮ | ⋮ | ⋮ | ⋮ | ⋮ | ⋮ | ⋮ | |

F I G. 17

MUSICAL SCORE BLOCK COPY FORMING APPARATUS

BACKGROUND OF THE INVENTION

The present invention relates to a musical score block copy forming apparatus which can display a musical score on the basis of notes input by key operations on a musical keyboard and other musical score data, so that its layout can be changed on a screen Various attempts have been made to develop a musical score block copy forming apparatus for inputting musical score data and forming a block copy of a musical score on the basis of the input musical score data. In general, of the musical score data, note data are of prime importance, and European Patent Disclosure No. 53393 discloses an example of the way of inputting and processing the note data. Acccording to the invention disclosed in this disclosure, note data is input at a function keyboard together with tone pitch data and tone duration data. When an accidental (e.g., sharp "#", flat "?", or the like) is to be added to a note, a function key meaning the accidental is depressed to input the accidental. In such an input method, note data is input by inputting tone pitch data and tone duration data at the function keyboard, and an input operation cannot be smoothly performed. More specifically, a chord representing that three or more tones are played at the same time must be input by separately inputting constituting tones.

An original of a musical score to be printed is normally a handwritten musical score. If tone pitch data can be input at a piano keyboard like in a performance of a piano while observing this original, an input time can be shortened. To realize this, a method of inputting tone pitch data using a piano keyboard input device is disclosed in British Patent No 1337201. According to the method disclosed in this British patent, note data can be input more smoothly than by using a function keyboard, and it is preferable that an accidental is input by depressing a black key of piano keys.

However, in such a system, as described in U.S. Pat. No. 4,603,386, edited musical score data is temporarily transferred to a host computer, and is printed out by a graphic printer, resulting in a large-scale system. In recent years, an apparatus has been developed wherein a musical score block copy forming apparatus is separated from a host computer, and a musical score is formed by a personal computer. An output device for forming a block copy is connected to a personal computer so as to facilitate formation of a block copy. Since input musical score data forms a musical score on a display screen in accordance with an original, a great advance can be achieved as compared to a conventional musical score block copy forming apparatus which displays note data as codes.

The personal computer type musical score block copy forming apparatus for forming a musical score has the following problems.

More specifically, musical score data input at a piano keyboard and a function keyboard are displayed on a music sheet on a screen on the basis of a predetermined layout (assignment). However, the predetermined layout must be frequently changed during an operation. That is, in a musical score once formed, a staff gap is extended or notes are moved in units of measures. In this case, signature data, character data, word data, guitar chord data, and the like must be moved to follow extension of the staff gap or movement of the notes.

However, since the signature data, word data, guitar chord data, and the like are processed independently of the staff data and note data, when the layout of notes once formed is changed, various data must be separately moved, and a method of achieving this has not been established yet.

SUMMARY OF THE INVENTION

It is an object of the present invention to provide a musical score block copy forming apparatus which can modify a layout while displaying a musical score on a screen on the basis of notes and other musical score data input by key operations at a musical keyboard, and outputs the change result to form a block copy of a musical score.

A musical score layout change function used in this embodiment is not limited to extension of a staff gap of a musical score once formed or movement of notes in units of measures described above. This function also includes a function of performing automatic note assignment, i.e., a layout of notes on a staff, a function of positioning words on a musical score upon input of words in correspondence with notes and displaying an input state of the words, a function of automatically coupling flag notes such as eighth notes, sixteenth notes, and the like by beams, or the like. These functions are performed by the arithmetic processing means.

BRIEF DESCRIPTION OF THE DRAWINGS

FIG. 7 is a flow chart for explaining an embodiment of a layout change function;

FIG. 17 shows a Japanese conversion table;

DETAILED DESCRIPTION OF THE PREFERRED EMBODIMENT

A preferred embodiment of the musical score block copy forming apparatus of the present invention includes the following elements, which will subsequently be described in greater detail with reference to the drawings: first musical means, consisting of a full-scale key group in which keys corresponding to notes can be depressed simultaneously and a chromatic-scale key group in which keys corresponding to notes with accidentals can be depressed simultaneously, for inputting pitch data corresponding to a key operation; second musical keyboard means, consisting of a plurality of function keys and alphanumerical keys, for inputting data by operating these keys as tone duration data and other musical score constituting data; storage means for storing data input from the first and second musical keyboard means and data necessary for a musical score forming arithmetic operation; arithmetic processing means having a layout change function of performing a predetermined arithmetic operation for the data stored in the storage means and forming a musical score on the basis of the arithmetic result; display means for displaying the musical score formed by the arithmetic processing means on a screen; and output means, connected to the arithmetic processing means, for forming a block copy of the musical score displayed on the display means.

Figures 1, 3:
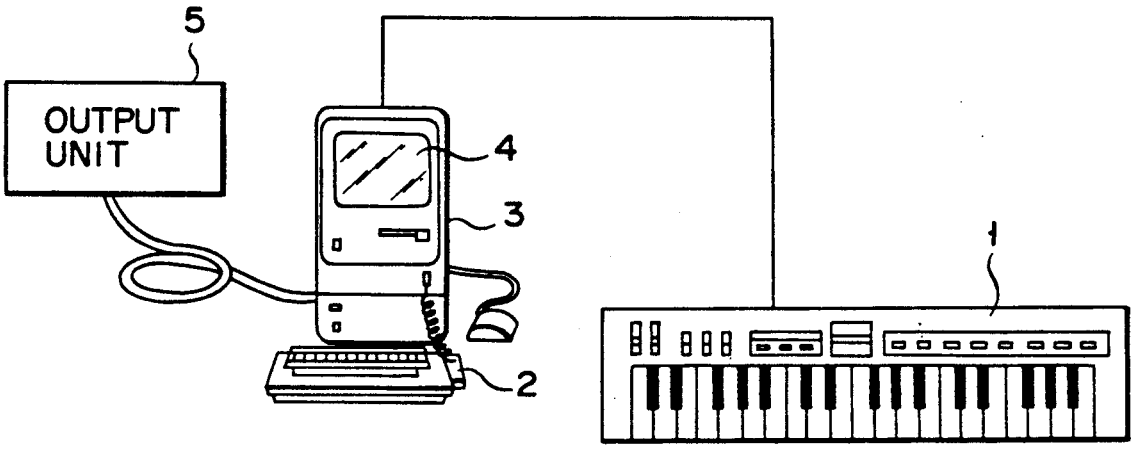
FIG. 1 is a view showing the overall arrangement of a musical score block copy forming apparatus according to the preset invention.
FIG. 3 is a table showing the relationship between note values of notes and note value numbers.

FIG. 1 is a schematic view of a musical score block copy forming apparatus according to the present invention. Reference numeral 1 denotes a piano keyboard having full-scale and chromatic-scale key groups in which a plurality of keys corresponding to notes can be simultaneously depressed and keys corresponding to notes with accidentals can be simultaneously depressed to input note data of an original; and 2, a function keyboard, having a plurality of function keys and alphanumerical keys, for inputting words or the like converted to codes. Reference numeral 3 denotes a personal computer having a memory for temporarily storing musical score data input from the piano keyboard and the function keyboard, and a control unit for performing a predetermined arithmetic operation for the musical score data stored in the memory and simultaneously modifying layout of each structure on the basis of the arithmetic result.

Reference numeral 4 denotes a display unit for displaying a formed musical score on a screen. Reference numeral 5 denotes a printer for printing a block copy of the displayed musical score. The musical score data stored in the memory includes row data, staff data, attack time data, note data, signature data, character data, word data, and guitar chord data.

Since each of these data is constituted by some data, it is called a structure. The signature, character, word, and guitar chord structures include distance data from a central point of a corresponding note. A given structure includes an address of another structure on the memory. For example, the note structure includes a memory address of the signature structure. This is called a pointer in the various structures.

Figure 2:
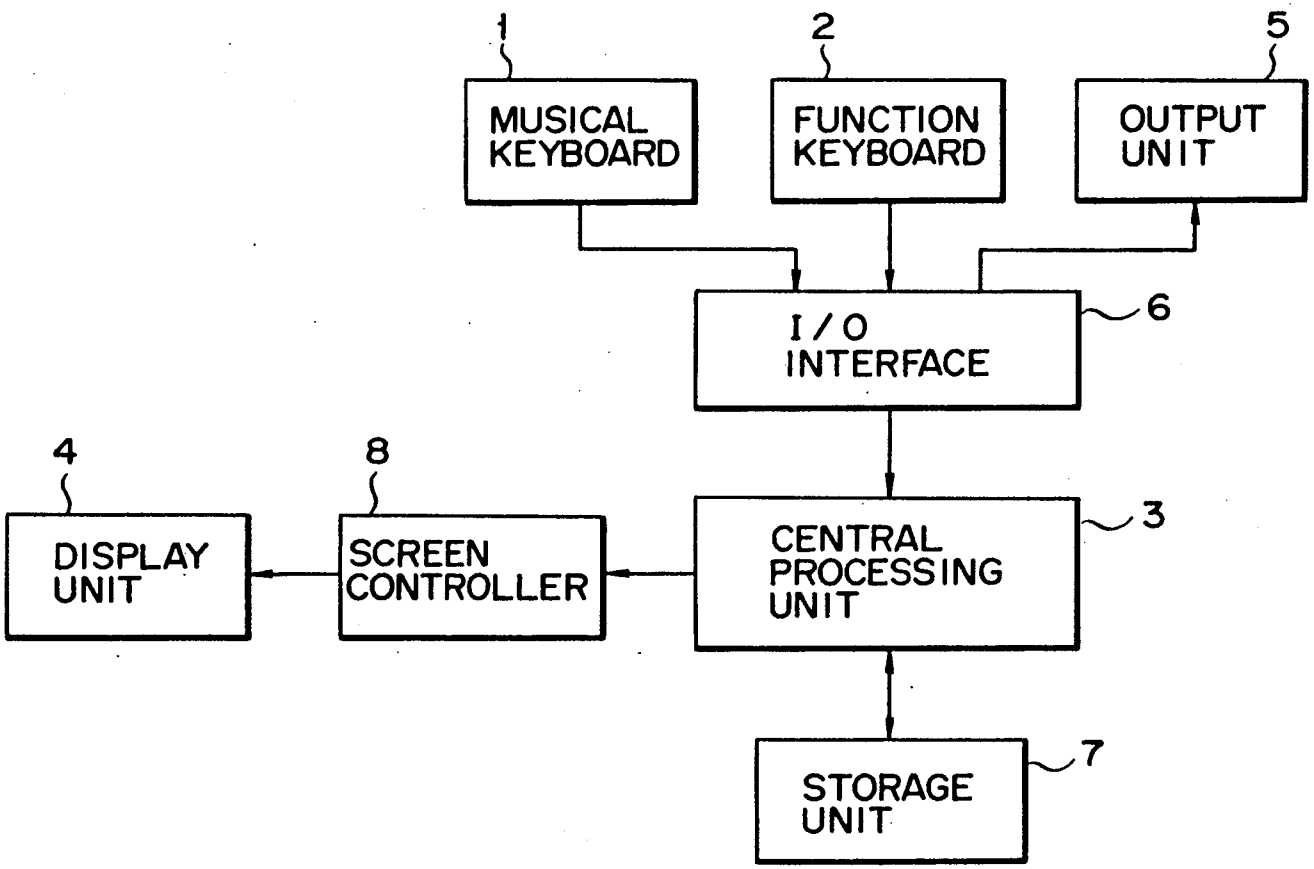
FIG. 2 is a block diagram showing an embodiment of the musical score block copy forming apparatus.

Row structure
accolade data
pointer to staff structure
pointer to attack time
structure
Staff structure
position data
size data
voice part data
clef data
time signature data
key signature data
pointer to signature structure
Attack time
attack time data
structure
position data
bar line data
pointer to note structure
pointer to word structure
pointer to signature structure
pointer to character structure
pointer to guitar chord
structure
Note structure
note value data
note duration data
clef data
time signature data
key signature data
movement data
accidental data
type data
chord data
grace note data
beam data
pointer to signature structure
Word structure
distance data
font data
size data
character data
pointer to signature structure
Character
distance data
structure
font data
size data
character data
pointer to signature data
Guitar chord
distance data
structure
font data
size data
character data
Signature
distance data
structure
type data The schematic view of the musical score block copy forming apparatus shown in FIG. 1 can be expressed by the block diagram shown in FIG. 2. More specifically, data input by key operations at the musical keyboard 1 and the function keys 2 are input to a central processing unit 3, a so-called CPU through an I/O interface 6, and are temporarily stored in a storage unit 7 as a structure. Thereafter, arithmetic processing with other input data is performed to execute the respective functions. The arithmetic result is displayed on the display unit 4 through a screen controller 8. A display content can be visually observed, and a layout can be desirably changed. The display result is output to the output unit 5, thereby printing a block copy of a musical score.

Figure 4:
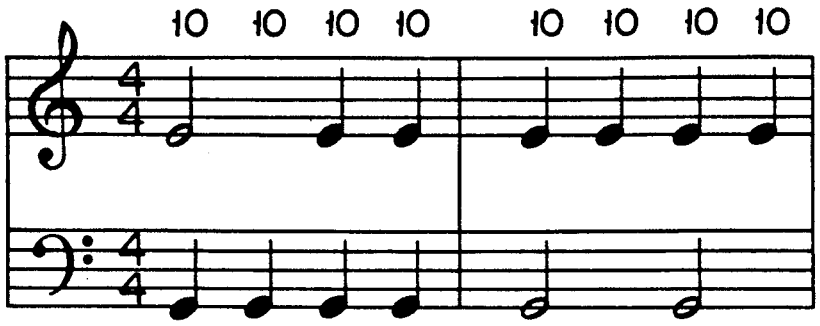
FIG. 4 shows a musical score showing attack times.

Setting of an attack time will be described below with reference to FIGS. 3 and 4. FIG. 4 shows a musical score for two voice parts each consisting of two measures in 4/4 time, and reference numeral 10 indicates locations of attack times which are not displayed on the screen. The position of each attack time indicates a position where at least one note or rest is present on a staff in units of rows.

Figure 5:
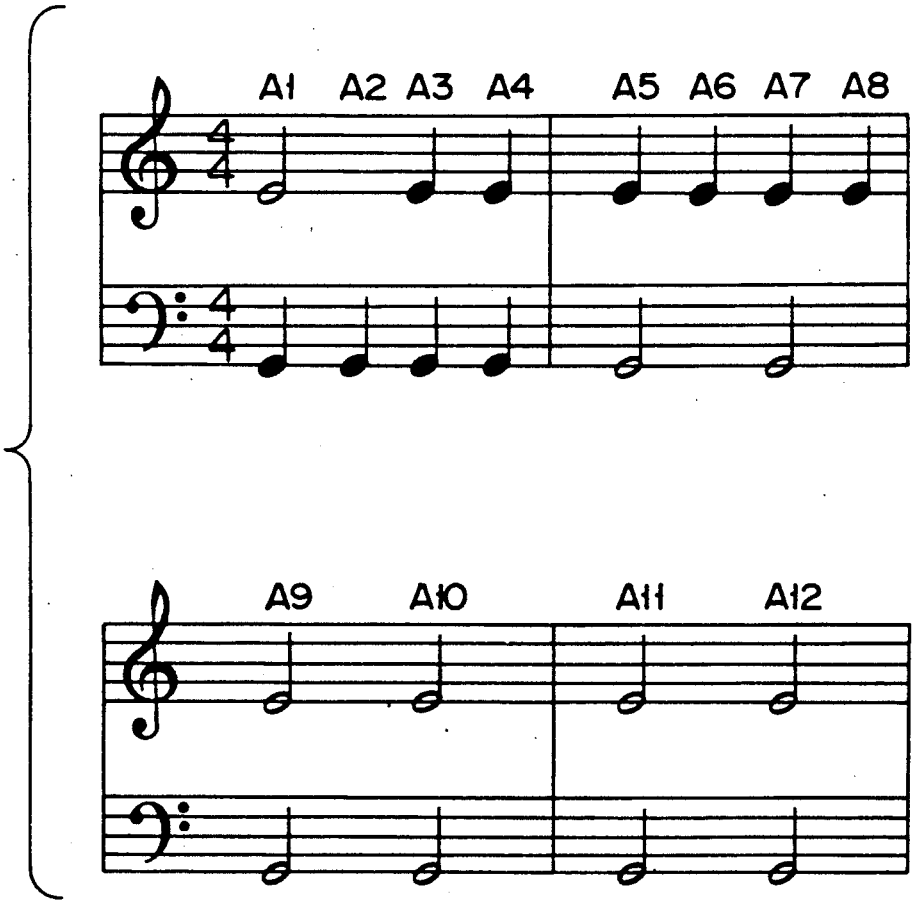
FIG. 5 shows a musical score before a layout is changed.
Figure 6:
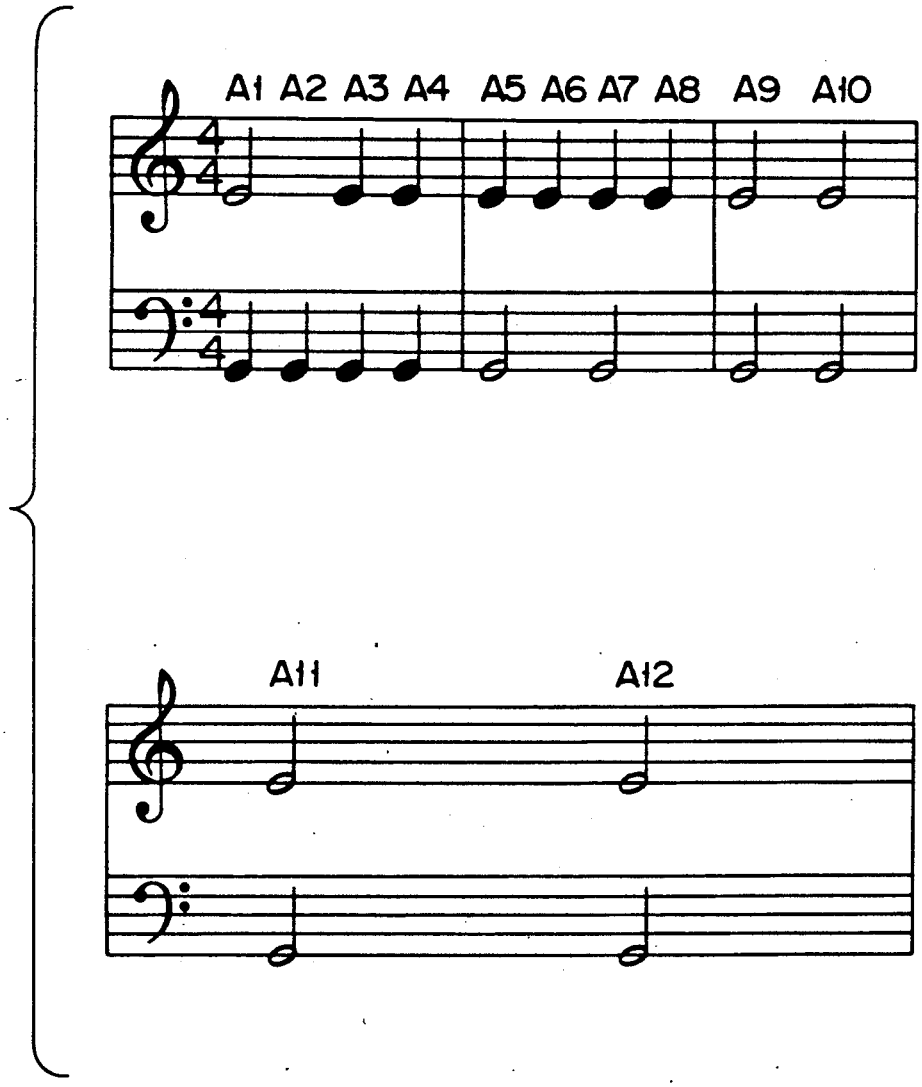
FIG. 6 shows a musical score after a layout is changed.

The attack times have serial numbers on a musical score, and are assigned as shown in FIG. 5. Therefore, each row has inherent attack times. In FIG. 5, an attack time at the beginning of a row #1 is A1, and an attack time at its end is A8. An attack time at the beginning of a row #2 is A9, and an attack time at its end is A12. If FIG. 5 shows a musical score based on an initially set layout, FIG. 6 shows a musical score after a layout is changed A layout change procedure will be described below with reference to the flow chart shown in FIG. 7. When an operator sets an initial value associated with a layout of a musical score (S1), row data, accolade data, and staff data are displayed on the screen on the basis of the initial value (S2).

The operator inputs note data, character data, word data, signature data, guitar chord data, and the like using the piano keyboard and the function keyboard, and at the same time, these data are automatically displayed on the screen (S3).

The operator judges whether or not a layout must be changed while examining a musical score formed on the screen (S4). If it is determined that the layout must be changed, the operator changes attack times at the beginning and end of a row requiring a change of the layout (S5). Thus, the row data is automatically initialized so as to re-display first to last rows (S6).

The accolade data of the rows and staff data of each row are displayed (S7), the positions of all the attack times of each row are automatically determined (S8), and bar lines of each row are displayed (S9). On the basis of the attack time data, the note, character, signature, and guitar chord data are displayed at predetermined positions of the musical score on the screen (S10). It is automatically checked if the last attack time of each row is one when the layout is changed (S11). A similar operation is repeated while increasing the number of attack times, thus completing the layout change operation.

Of the musical score layout change functions of the musical score block copy forming apparatus of the present invention, an embodiment of a function of automatically assigning notes will be described below with reference to FIGS. 8 to 16.

As described above, musical score constituting data input at the piano keyboard and the function keyboard are displayed on the staffs on the screen in accordance with a predetermined layout. In this case, note assignment on a staff of a musical score requires a considerable skill, and it is difficult for a novice user to appropriately perform note assignment. When notes are to be corrected or a layout is to be changed, it is difficult for him or her to rapidly cope with this. Even though assignment is performed by a computer, the computer performs assignment using only note values. Therefore, when a musical score including complicated accidentals, words, and the like is to be input, it is impossible to perform automatic assignment. An embodiment to be described below is made to solve the abovementioned problems. When a musical score including complicated accidentals, words, and the like is to be input, a less skilled novice user can easily and automatically perform note assignment onto staffs of the musical score. After note assignment, he or she can rapidly correct notes or change a layout.

In this embodiment, the automatic note assignment function is executed by the arithmetic control unit in the personal computer 3 shown in FIG. 1, i.e., the CPU 3 shown in FIG. 2.

First, note assignment conditions include the following items.

(1) A distance between notes having the same note value in a single row of a musical score must be basically the same.

(2) An accidental must not contact an immediately preceding note.

(3) A note with a word must be moved so that adjacent words do not contact each other.

(4) A resultant score must be nice to look at.

A note assignment method on a musical score will now be described.

Figure 8:
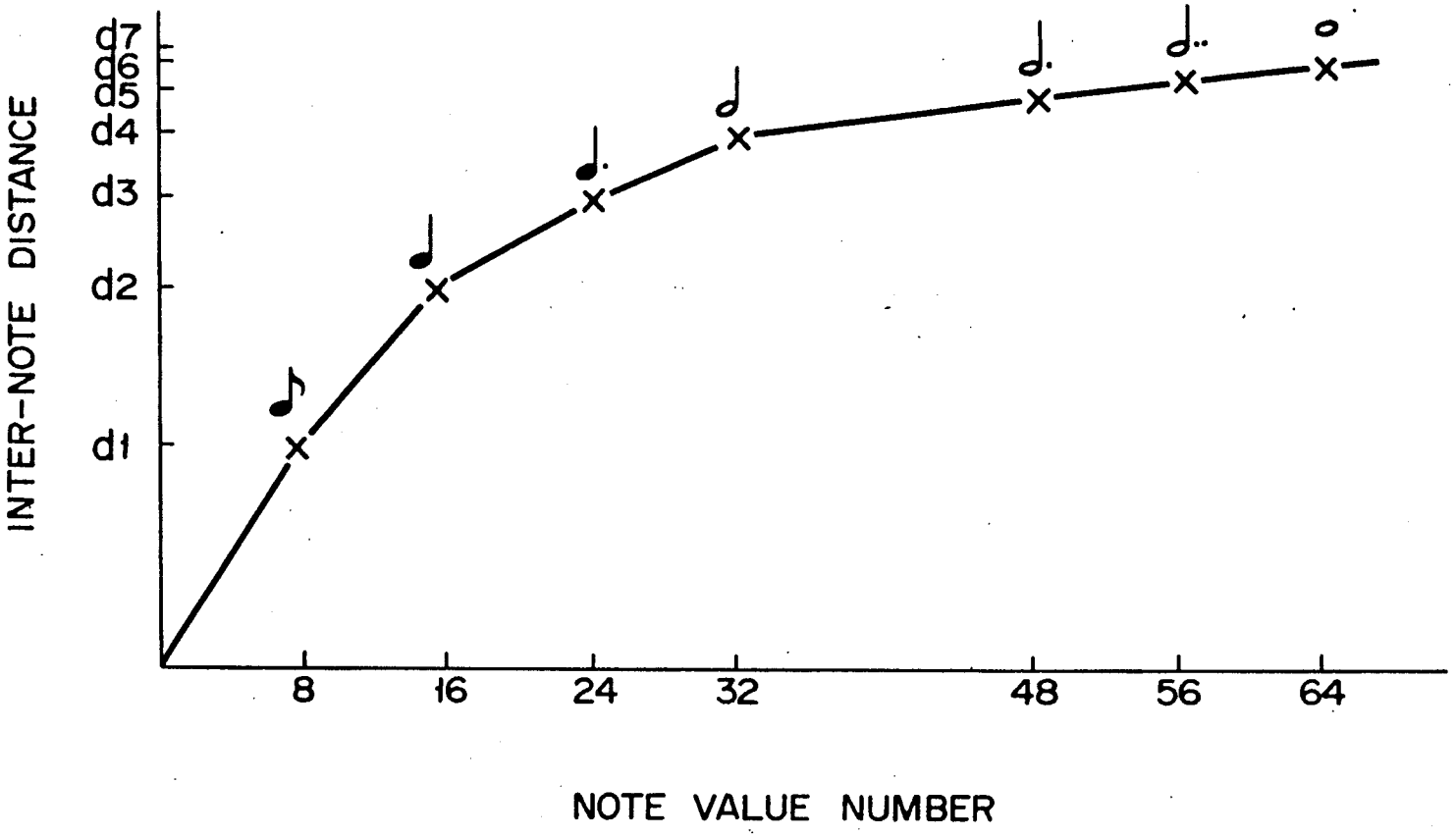
FIG. 8 is a graph showing the relationship between a note value number and an inter-note distance when a minimum note value is an eighth note.

In order to express a note value by a numerical value, note value numbers are determined as shown in FIG. 3. For example, the note value number of a dotted quarter note is $16+8=24$. Meanwhile, an inter-note distance in one row is determined on the basis of a minimum note value. The minimum note value is one of a minimum note appearing in one row. In the case of a dotted note, a note value corresponding to a dot is used. For example, a dotted quarter note has a note value corresponding to an eighth note. The inter-note distance is not simply proportional to a note value but is determined as shown in FIG. 8. The relationship between note values and inter-note distances can be determined according to a favor of a musical score creator.

Figure 9:
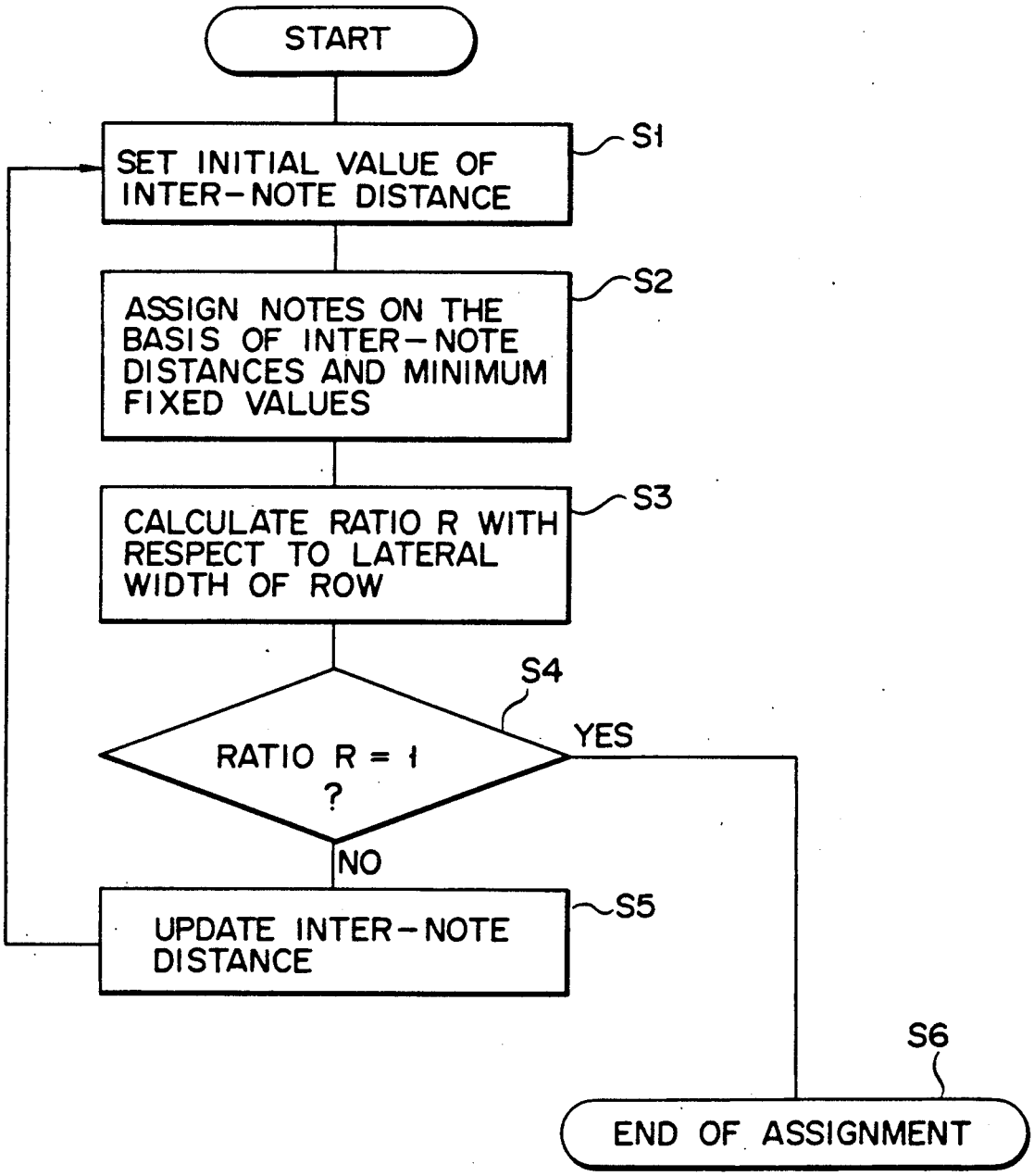
FIG. 9 is a flow chart for explaining the operation in the embodiment, shown in FIG. 8.

The automatic note assignment operation in the musical score block copy forming apparatus of this invention will now be described with reference to the flow chart shown in FIG. 9.

Note assignment in a simple note string with neither accidentals nor words will be explained below.

Figure 10:
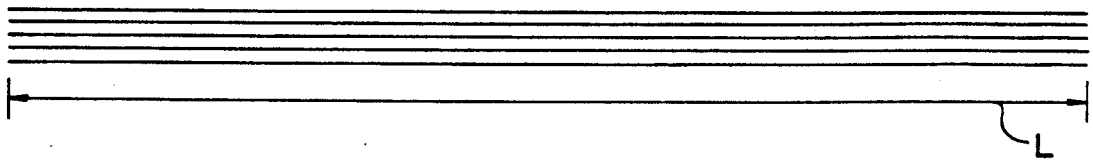
FIGS. 10 to 16 show musical scores for explaining an automatic note assignment operation on the basis of the flow chart shown in FIG. 9.
Figure 11:
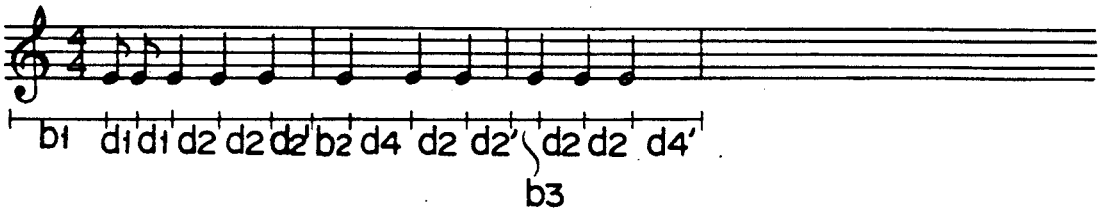

An operator sets initial values of inter-note distances (S1). More specifically, as shown in FIG. 10, a distance serving as an object of note assignment is a distance L from the first bar line of a row of a musical score to the last bar line of the row, and notes are assigned with reference to this distance L. In this case, as shown in FIG. 11, inter-note distances of respective note values are represented by d1, d2, d3, . . . , in correspondence with respective notes. For a distance between the last note of a measure and a bar line at the end of this measure, a distance smaller than an inter-note distance of the same note value as the last note is assigned, and is represented by d1', d2', d3', . . . ,. A distance between a bar line and a first note of the corresponding measure is called a bar line space, and is represented by b1, b2, b3, . . . .

Next, a value necessary for note assignment is calculated on the basis of the inter-note distances, distances each between the last note of a given measure and a bar line at the end of the given measure, and the bar line spaces, and is represented by SP (S2). More specifically, in FIG. 11, $$SP = \underline{b1 + b2 + b3} + \underline{d1 + d1 + d2 + d2 + d4 + d2 + d2 + d2} + \underline{d2' + d2' + d4'}$$

A ratio R=L/SP of the value SP to the assignment distance L as a distance from the first bar line of a given row of a musical score to the last bar line of the given row is calculated (S3).

It is then checked if the ratio R is almost 1(within the range wherein R does not exceed 1) (S4). As a result, if R is not 1, the inter-note distances are updated (S5). More specifically, the inter-note distances (d1, d2, d3, . . . , and distances d1', d2', d3', . . . , each between the last note of a given measure and a bar line at the end of the given measure) are updated.

$$d1 = d1 \times R \quad d1' = d1' \times R$$
$$d2 = d2 \times R \quad d2' = d2' \times R$$
$$d3 = d3 \times R \quad d3' = d3' \times R$$

Figure 12:
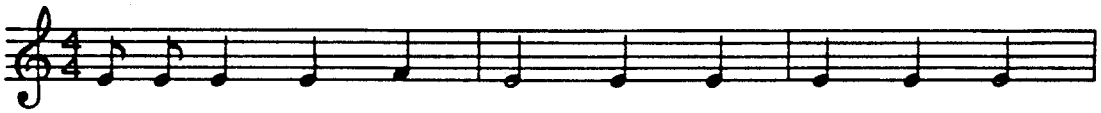

In this manner, the distances are updated until R becomes almost 1, the final inter-note distances are determined, and note assignment is completed, as shown in FIG. 12 (S6).

Note assignment in a complicated note string including accidentals, words, and the like will be described below.

An operator sets initial values of the inter-note distances as described above (S1).

Next, a value necessary for note assignment is calculated on the basis of the inter-note distances, distances each between the last note of a given measure and a bar line at the end of the given measure, the bar line spaces, and a minimum fixed value, and is represented by SP.

Figure 13:
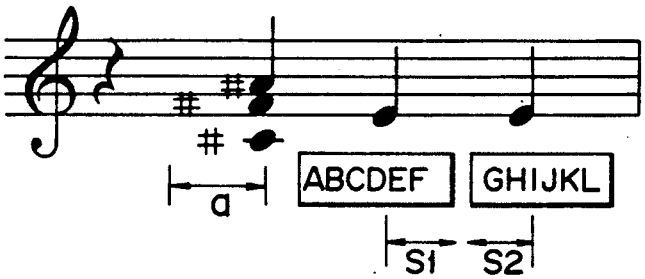

In this case, the minimum fixed value is a minimum, necessary distance which must be taken into consideration when note assignment including accidental widths and inter-word distances is performed, and is a largest value of an inter-note distance, an accidental width, and an inter-word distance of each note. More specifically, as shown in FIG. 13, the accidental width is a distance a from the center of a note to the left end of an accidental, and the inter-word distance is determined with reference to a total value $c(=s_1+s_2)$ of $\frac{1}{2}(s_1)$ of a lateral width of a word of an immediately preceding note and $\frac{1}{2}(s_2)$ of a lateral width of a word of a present note.

Figure 14:
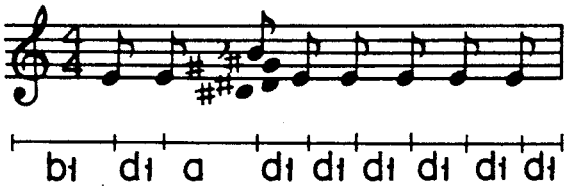

Optimal assignment is performed while comparing the inter-note distance (the minimum fixed values for notes including the accidental width, inter-word distance, and the like), the distances each between the last note of a given measure to the bar line of the given measure, and the bar line spaces. In this case, new inter-note distances are determined while maintaining at least minimum fixed values and the inter-note distances are updated, as shown in FIG. 14.

In this case, $$SP=b1+d1+a+d1+d1+d1+d1+d1+d1'$$

Then, the ratio R=L/SP of the value SP to the assignment distance L is calculated (S3). It is then checked if the ratio R is almost 1 (within the range wherein R does not exceed 1) (S4). As a result, if R is not 1, the inter-note distances are updated (S5). More specifically, the inter-note distances (d1, d2, d3, . . . ,) and distances (d1', d2', d3', . . . ,) each between the last note of a given measure and a bar line at the end of the given measure are updated. In this manner, the distances are updated until R becomes almost 1, the final inter-note distances are determined, and note assignment is completed (S6).

Figure 15:
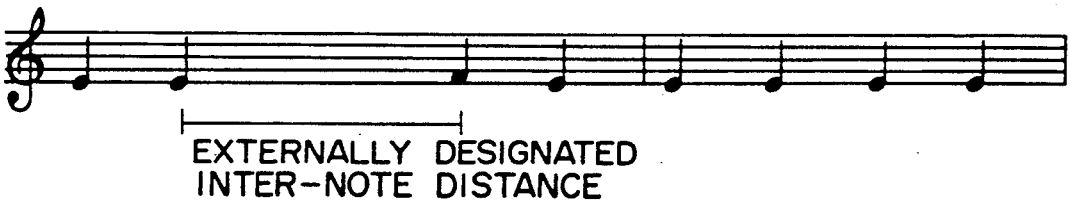

Note that as shown in FIG. 15, only a given inter-note distance can be externally designated, and processed as a minimum fixed value. In this case, correction after automatic assignment can be performed.

Figure 16:
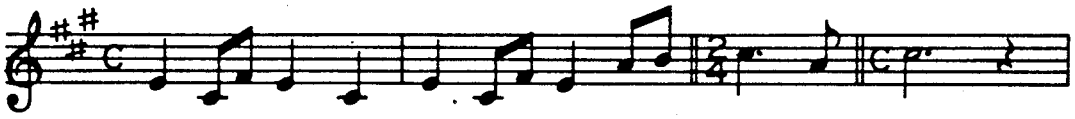

On a musical score including voice part signatures, time signatures, key signatures; types of bar lines, grace notes, and the like, when the lateral widths of the respective signatures and notes are considered as minimum fixed values, notes can be automatically assigned, as shown in FIG. 16.

As described above, the musical score block copy forming apparatus of this embodiment has a function of performing assignment in such a manner that the value SP necessary for note assignment is calculated on the basis of the inter-note distances, the distances each between the last note of a given measure and the bar line at the end of the give measure, and the minimum fixed values, the ratio R(=L/SP) of the value SP to the assignment distance L as a distance from the first bar line of a given row of a musical score to the last bar line of the given row is calculated, and the inter-note distances are updated until the ratio R becomes almost 1. Therefore, in a musical score including complicated accidentals, words, and the like, a less skilled novice user can automatically perform note assignment onto staffs of a musical score, which can be conventionally performed by only an experienced user upon formation of a musical score.

Of the musical score layout change functions of the musical score block copy forming apparatus according to the present invention, an embodiment of executing a function of positioning words on a musical score upon input of words in correspondence with notes and displaying an input state of the words will be described below with reference to FIGS. 17 to 27.

Figure 26:
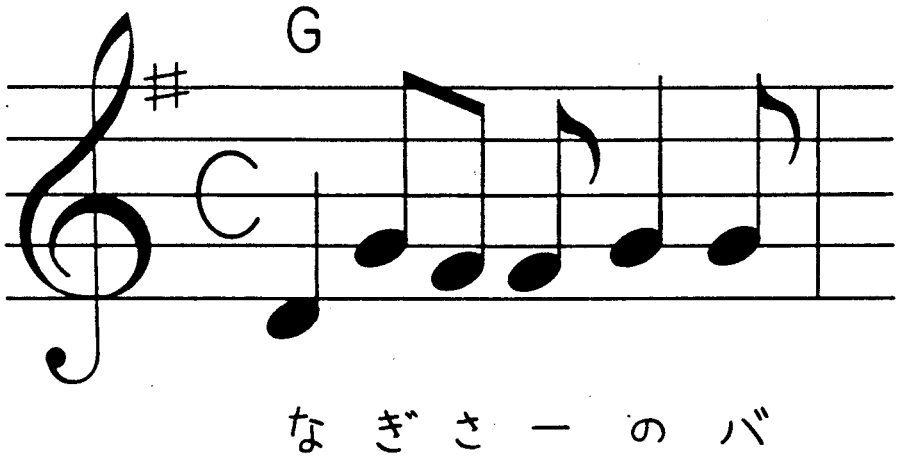
FIG. 26 is a view showing the relationship between words and a chord on a musical score.
Figure 27:
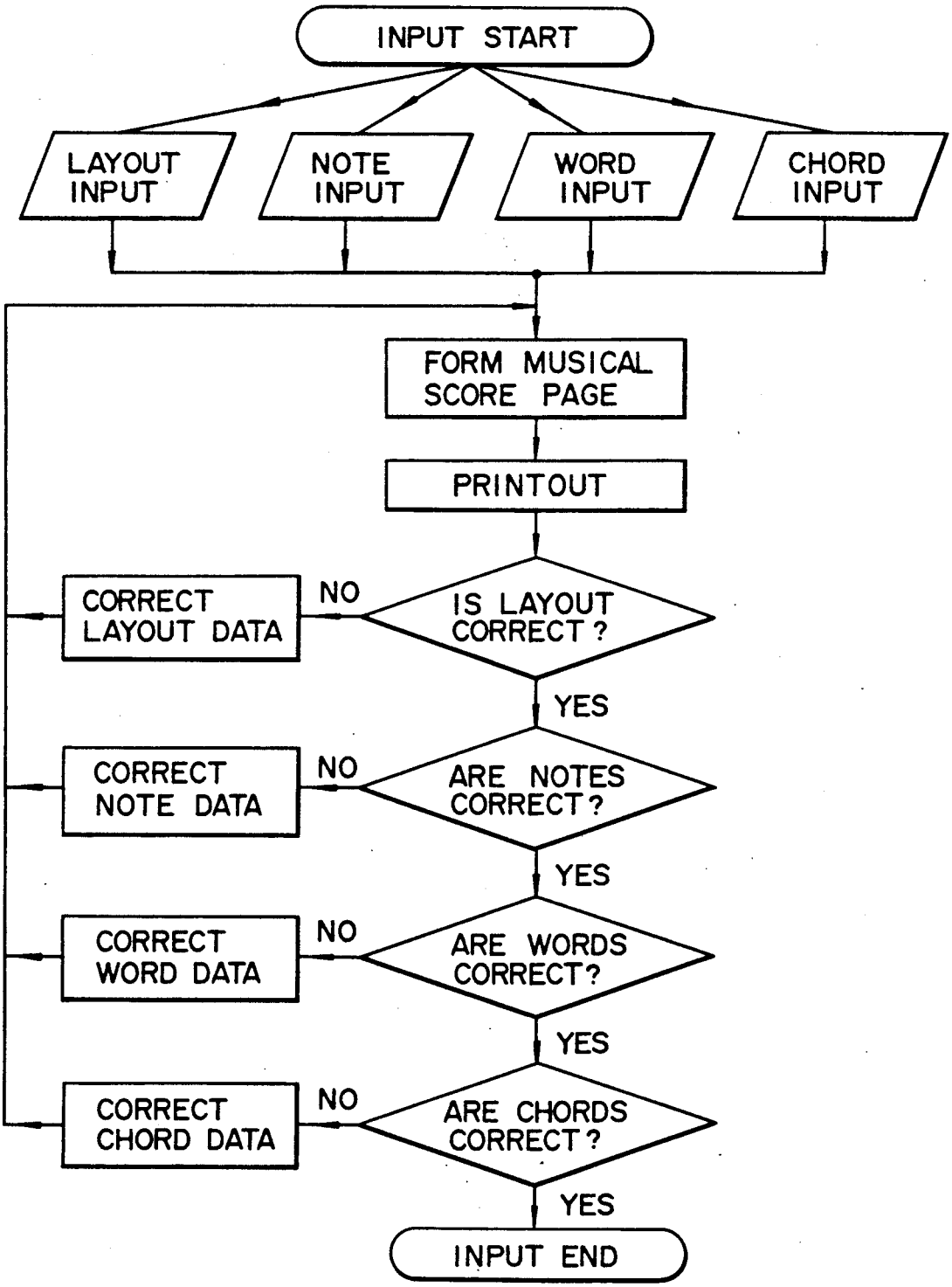
F I G. 27 (PRIOR ART)
FIG. 27 is a flow chart showing a conventional confirmation operation for confirming a input operation.

In the musical score block copy forming apparatus, no problem is posed for a simple musical score with neither words nor chords. However, when a musical score including complicated words, chords, and the like as shown in FIG. 26 is to be input, word data and chord data are separately input in correspondence with notes and are converted to corresponding data codes, and the coded data are re-converted to a musical score. After data for one page is input, the input musical score is output. A user visually confirms a printout. When the user finds an error, he or she corrects corresponding portions of word data and chord data, and re-outputs the corrected data. FIG. 27 is a flow chart showing an input method of this type.

Therefore, in the input method of the words and chords, a printout time for several times is required until data can be perfectly corrected, resulting in a considerable time loss and an increase in cost accordingly. Whether or not input word data and chord data correctly correspond to note data can only be checked after the user actually confirms a printout.

An embodiment to be described below is made to solve the above-mentioned problem. In this embodiment, words can be easily, quickly, and accurately input, and its input state can be visually observed in real time.

Figure 18:
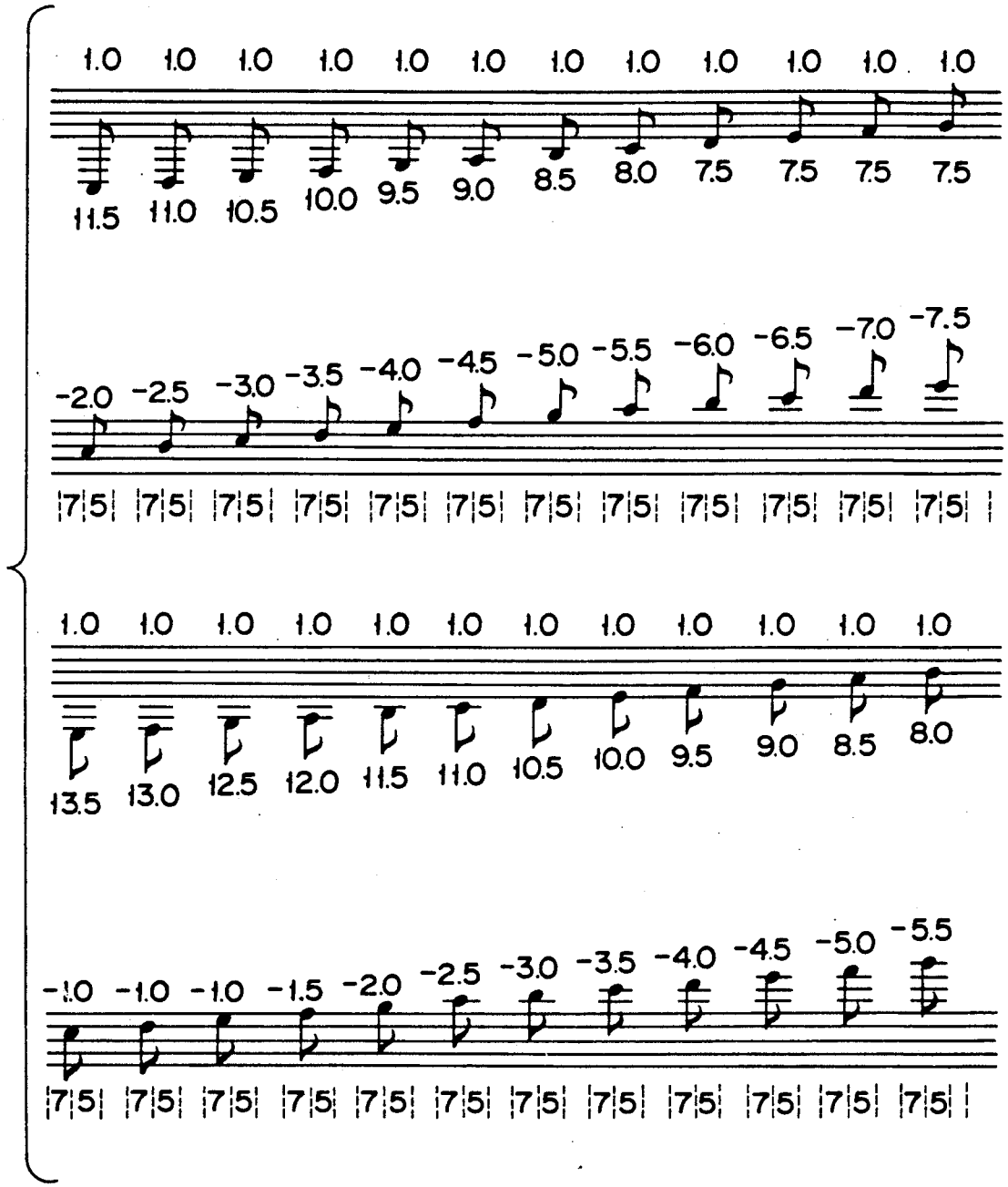
FIG. 18 shows a table showing a correspondence between a given quarter note at a lowermost position in a staff and a numerical value representing a distance to a corresponding word for positioning it on a musical score.
Figure 19:
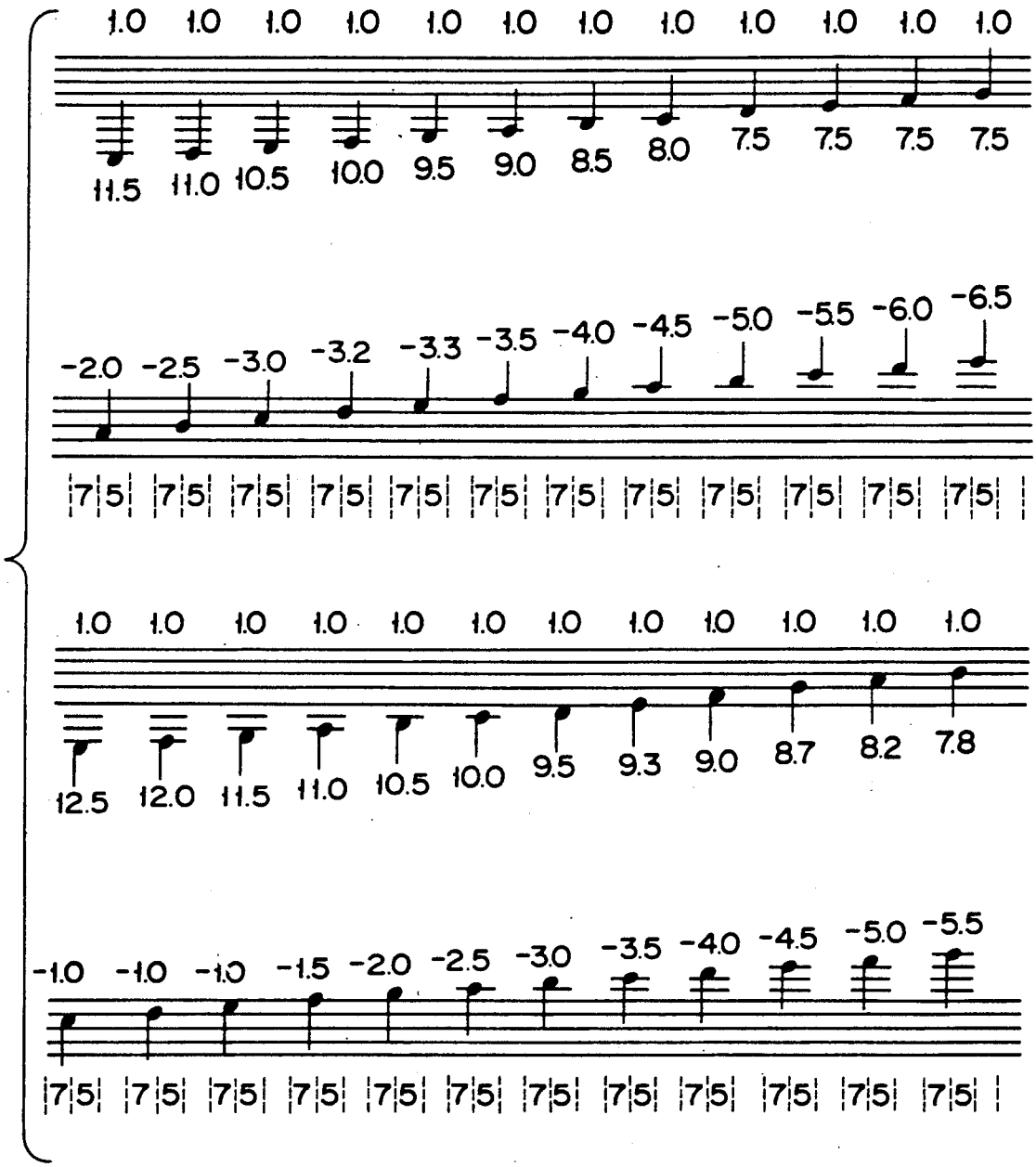
FIG. 19 shows a table showing a correspondence between a given half note at a lowermost position in a staff and a numerical value representing a distance to a corresponding word for positioning it on a musical score.

An arithmetic processing unit of this embodiment has a function of receiving word data input at the English keyboard 2 while positioning them in correspondence with notes on staffs of a musical score, and displaying the input state on the display unit every time data is input, i.e., a word input function. Data stored in the memory includes row data, staff data, note data (tone pitch data and tone duration data), signature data, a Japanese conversion table, a word lowermost tone table, a font (type face) table, and the like. The Japanese conversion table is used when words input in Roman characters are converted to corresponding Japanese words, and is stored in the form of a table, as shown in FIG. 17. A correspondence between a given note at a lowermost position in a staff and a device representing a distance to a corresponding word for positioning it on a musical score is stored in the form of a table, as shown in FIGS. 18 and 19.

A data input operation in the musical score block copy forming apparatus of this embodiment will be described below with reference to the flow charts shown in FIGS. 20 and 21.

An operator inputs layout data to display a staff, a time signature, a voice part signature, a key signature on the screen of the display unit 4 (S1). The operator visually observes the display screen to check if the layout is correct (S2). As a result, if the layout is not correct, the operator corrects the layout data until the correct layout is obtained (S3). After the operator confirms that the correct layout is obtained, he or she inputs note data at the piano keyboard 1 to display them on the screen of the display unit 4 in the form of notes (S4). The operator visually observes the display screen to check if the note data is correctly input (S5). If the note data are not correct, he or she corrects the note data until correct note data are obtained (S6).

After the operator confirms that the correct note data is obtained, he or she inputs words in Roman characters, so that the input words are displayed on the screen of the display unit 4 in the form of notes in real time (S7). More specifically, when the word data are input, the arithmetic control unit in the personal computer 3 checks if the input data is the word data (S8-1). If it is determined that the input data is the word data, it is then checked if the word data are Japanese words (S8-2). If it is determined that the word data are Japanese words, the word data input in Roman characters are converted to corresponding Japanese words on the basis of the Japanese conversion table (FIG. 2) stored in the memory in the personal computer 3 (S8-3). More specifically, Japanese words read in Roman characters and input at the English keyboard 2 are converted to Japanese codes while dividing them into syllables of the corresponding Japanese words.

In the arithmetic control unit in the personal computer 3, the word data converted to Japanese words are assigned to corresponding notes. In this case, when a word " " is assigned to a note shown in FIG. 22, a length M of the word (from the left end of " " to the right end of " ") is calculated, and a positioning calculation in the horizontal direction with respect to the note of the word is performed to have, as a start point of the word " ", a point offset by M/2 to the left from the center in the horizontal direction of the note (S8-4). On the other hand, a lowermost note in the staff of a musical score to which the word is assigned is searched. The lowermost note is one located at a lowermost position in the staff where when a word is assigned to a note, the position on the musical score to which the word is assigned does not interfere with the corresponding note. For example, a positioning calculation of the word " " in the vertical direction with respect to the note is performed on the basis of, e.g., FIGS. 18 and 19 (S8-5). For example, in FIG. 23, a lowermost note having an upward stem is a fourth note, and a lowermost note having a downward stem is second and seventh notes. In this case, the lowermost note is determined as follows. From the table shown in FIG. 19, the value of the fourth note is 7.5, and the values of the second and seventh notes are 7.5. A note having a larger value 7.8 of these values is determined as a lowermost note. The value "7.8" implies that when a distance between first and second lines of the staff is determined as 1.0, the lower line of a word is located at a position lowered from the fifth line by a distance of 7.8. Note that in FIGS. 18 and 19, values are written above and below the staff. These upper and lower values are used when words are assigned above and below the notes, respectively. The word " " is displayed on the screen of the display unit 4 in accordance with the positioning calculation results of the word " " in the horizontal and vertical respect to the note (S8-6). If it is determined in step S8-2 that the word data are not Japanese words (e.g., "you are boy . . . , ", the flow directly advances to step S8-4.

With the same operation as described above, word data " ", " ", " ", . . . , are sequentially input, and words are displayed on the screen of the display unit 4 until all the words for one page of a musical score are input (S8-7).

When the word data for one page of the musical score are input, it is then checked if the words include a hyphen (S8-8). If the words include a hyphen, hyphen processing is executed (S8-9). More specifically, the hyphen processing is performed to join words assigned to two notes through a short lateral bar, and a note may be present between the two notes. If the length of a hyphen is represented by M, the distance between adjacent hyphens is represented by J, and a distance between adjacent words is represented by L, the number of hyphens is calculated as follows.

$$(L-J)/(M+J)=K$$

(K is a value obtained by rounding a decimal part of K+1)

When the hyphen processing is completed, it is then checked if a melisma is present in words (S8-10). If it is determined that a melisma is present, melisma line processing is executed. In this melisma line processing, an underline is drawn, as shown in, e.g., FIG. 29.

Figure 20:
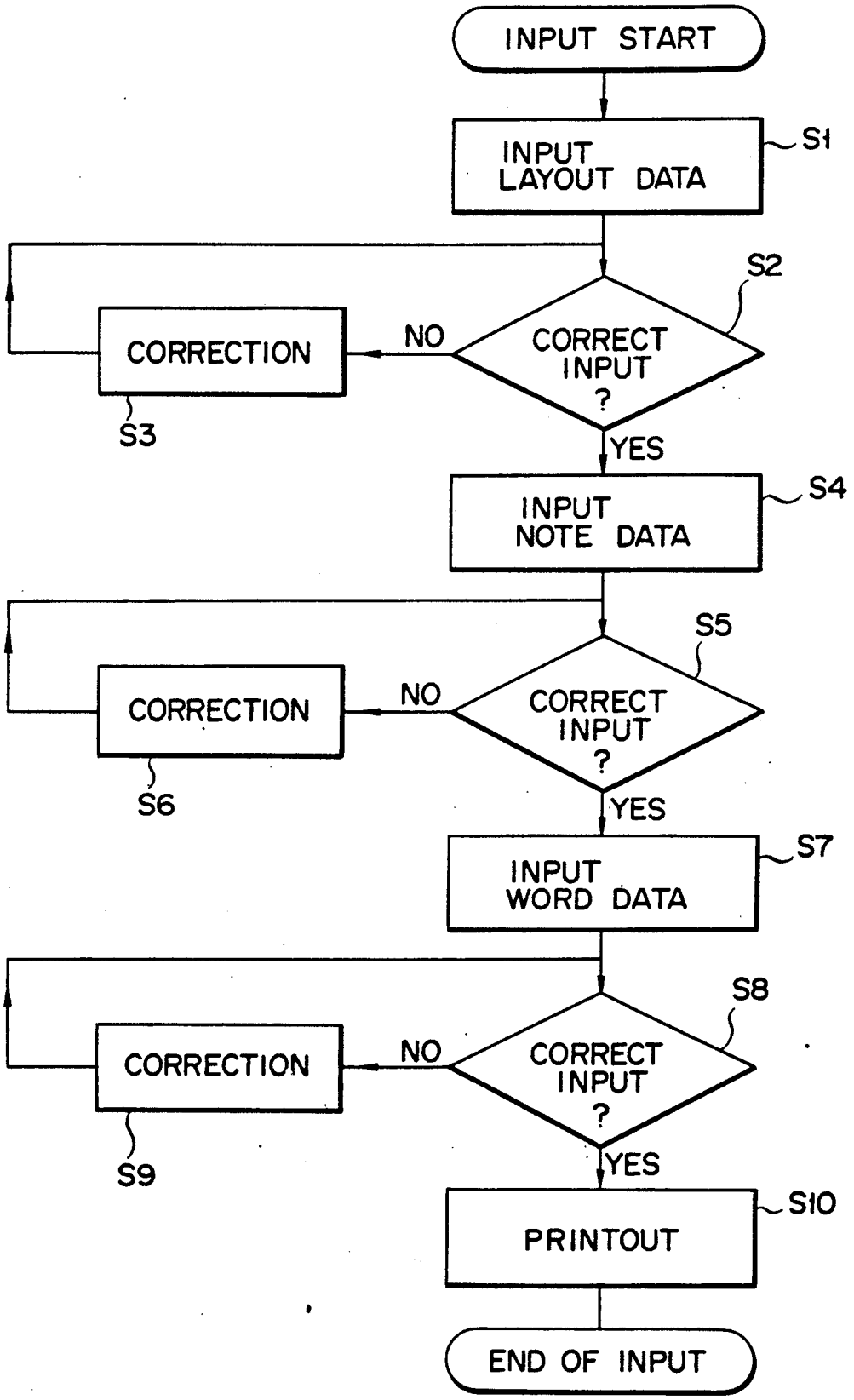
FIG. 20 is a flow chart for explaining a positioning operation of words on a musical score.
Figure 21:
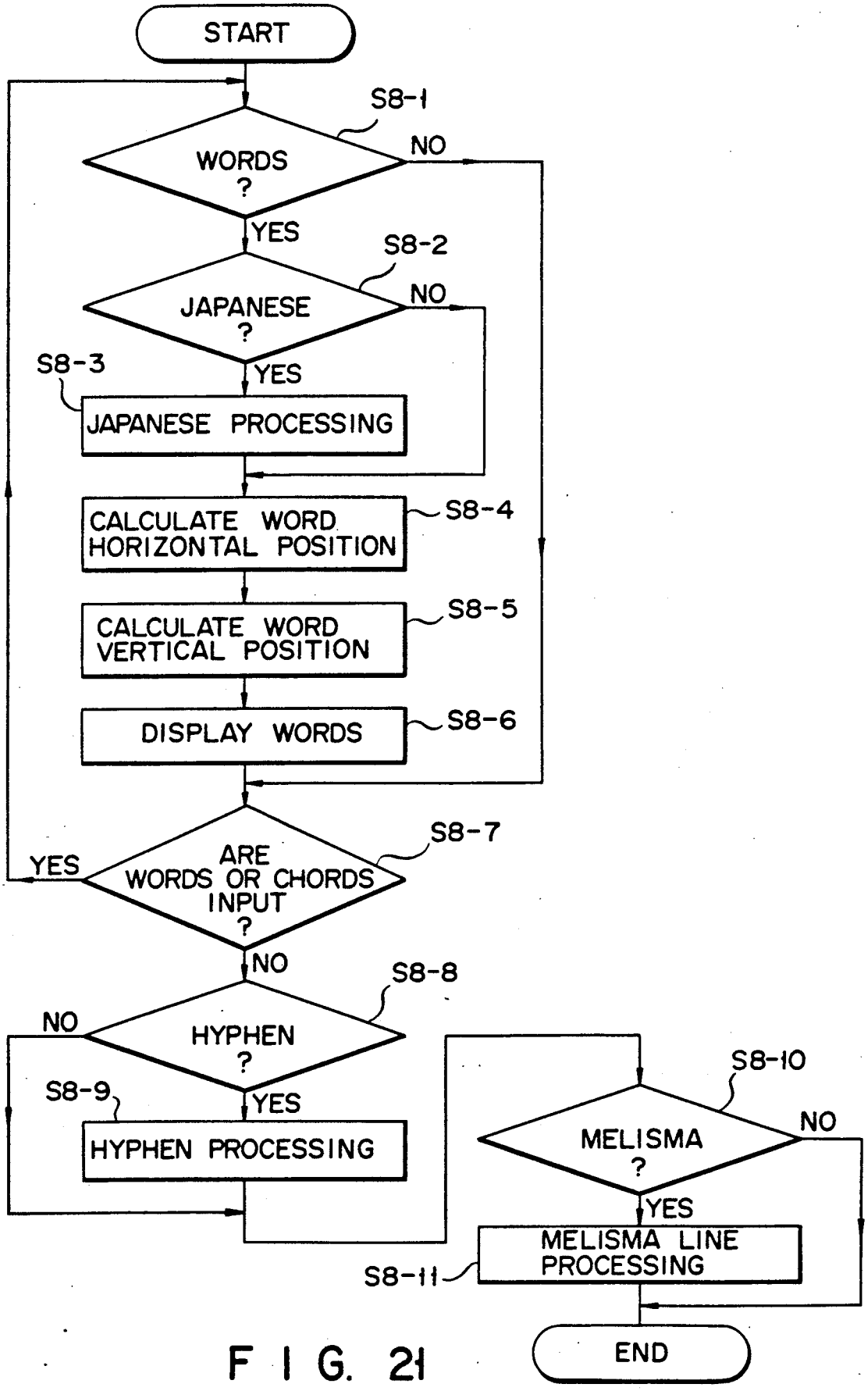
FIG. 21 is a flow chart for explaining different operations depending on contents of displayed words.
Figure 22:
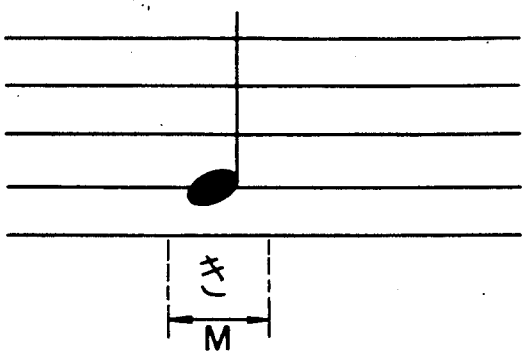
FIGS. 22 to 25 are views for explaining positioning operations of words in correspondence with notes.
Figure 23:
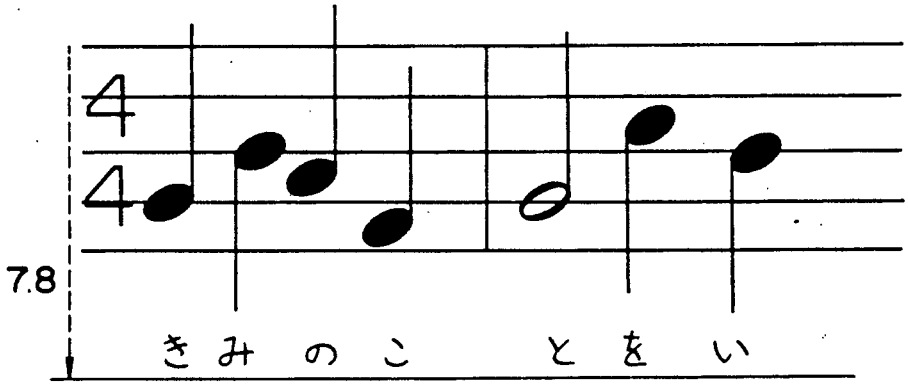
Figure 24:
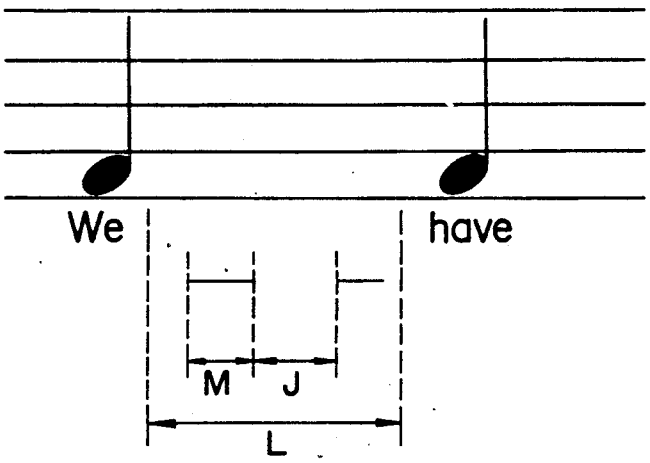
Figure 25:
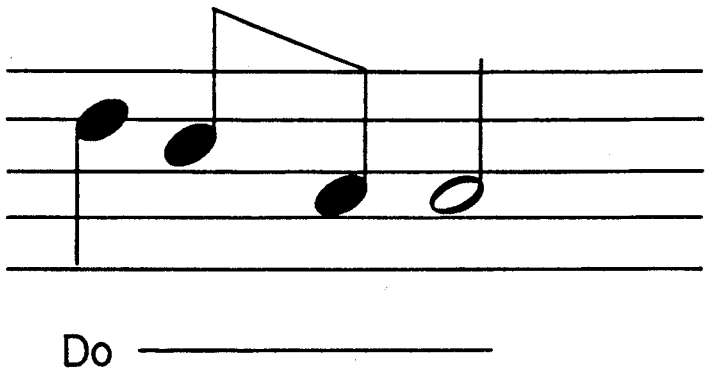

After the word data for one page of a musical score is input, the operator visually observes the input state on the display screen of the display unit 4 to check over the entire page of the musical score if the word data are correctly input (S8), as indicated by the flow chart in FIG. 20. As a result, if an error is found in the input word data, the error portion is corrected while observing the screen (S9). If all the input data are correct or correct data are obtained by correction, the page of the musical score is printed out by the printer 5, thus completing input of the word data.

In the above embodiment, the size of a character displayed on the screen on the display unit every time word data is input can be arbitrarily selected by the operator, and is normally 1.5 to 1.7 times a distance between lines of a staff of a musical score. The font of a character displayed on the screen of the display unit 4 is determined on the basis of the font table stored in the memory of the personal computer 3.

As described above, the musical score block copy forming apparatus of this embodiment has a function of positioning a word in the horizontal direction with respect to a note on the basis of a distance (width) of the word corresponding to the note, and positioning a word in the vertical direction with respect to a note on the basis of a lowermost note in a staff of a musical score to which words are to be assigned. Therefore, since the input state of words can be visually confirmed in real time, an input error can be immediately corrected and a correct input result can be obtained within a short period of time. Thus, an increase in time loss or a waste of cost until data is perfectly corrected like in a conventional apparatus can be prevented. Input word data can be automatically positioned with respect to a note, and is displayed on the screen of the display unit 4 in real time. Therefore, input of words can be easily, quickly, and accurately performed, and its input state can always be visually confirmed.

In the above embodiment, a case has been exemplified wherein word data are input. The present invention is not limited to this. Chord data can be input in substantially the same manner as in input of word data, except that a vertical position value with respect to the staff is arbitrarily set by the operator.

Of the musical score layout change functions of the musical score block copy forming apparatus according to the present invention, an embodiment of executing a function of automatically joining successive flag notes such as eighth notes, sixteenth notes, or the like by a beam will be described below with reference to FIGS. 28 to 40.

Figure 36:
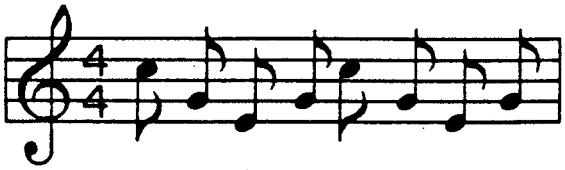
FIG. 36 (PRIOR ART)
FIGS. 36 to 40 are views for explaining conventional formation of a musical score including notes with beams.
Figure 37:
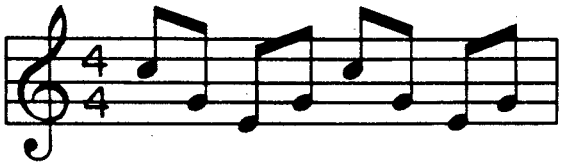
Figure 38:
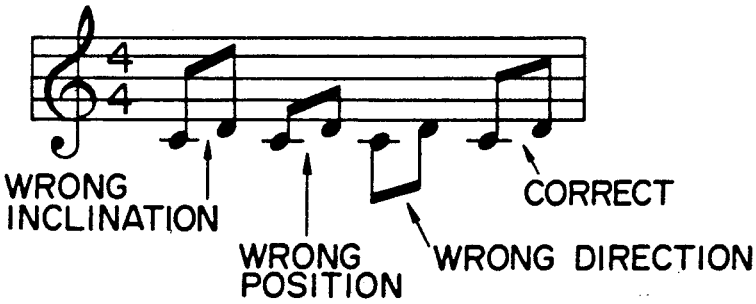

A musical score formed by the conventional musical score block copy forming apparatus is as shown in FIG. 36. A1 the notes are drawn as flag notes. However, on the musical score, notes must be theoretically joined by beams, as shown in FIG. 37. In this case, an inclination of the beam and its vertical position are strictly regulated. For example, the beams shown in FIG. 38 are not correct, i.e., have a wrong inclination, a wrong position, a wrong direction, and the like.

Figure 39:
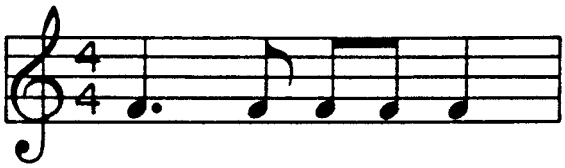
Figure 40:
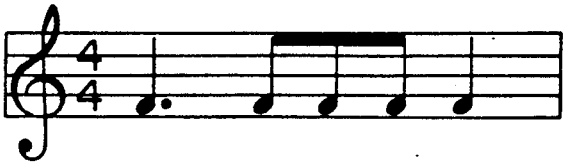

In some cases, a flag note must be used, as shown in FIG. 39. In this case, the notes should not be drawn, as shown in FIG. 40.

As a method of instructing whether sixteenth notes, thirty-second notes, and the like are drawn as flag notes or joined by beams, one of the following methods is employed in a conventional musical score block copy forming apparatus utilizing a computer.

More specifically, as shown in FIG. 36, all the notes are displayed as flag notes once, and after all the notes for one tune are input, the operator instructs notes which should be joined by the beams one by one.

In another method, data of indicating notes to be joined by beams is input in advance before notes are input. For example, in FIG. 37, data indicating that "join first and second notes, third and fourth notes, and fifth and sixth notes in a first measure by beams" is input.

Even if either method is employed, it takes a long time to form a correct musical score. The shape (inclination, position, and the like) of a beam drawn by the conventional technique is not satisfactory.

According to an embodiment to be described below, in order to solve the conventional problem that a long time is required to correct flag notes of a musical score formed by a conventional method to beam notes or to instruct notes which should be joined by a beam in advance, a system for automatically determining notes which should be joined by a beam during input of musical score data, and quickly displaying a correct shape on the screen is provided, thereby shortening an input operation time of musical score data, and standardizing the beam shape to be a correct one.

The principle of automatic formation of a beam in the embodiment 1 will be described below with reference to the drawings.

If a fundamental unit of time of a tune is represented by B and a note value number of each of input notes is represented by b, the following equation must be established as a necessary condition of a beam.

$$NB = \sum_{i=1}^{n} bi \tag{1}$$

where N is an arbitrary integer, and is the number of notes from the beginning of a measure. The fact that an immediately preceding note is a flag note is also a necessary condition. To satisfy these two necessary conditions is a necessary and sufficient condition of a beam.

Figure 29:
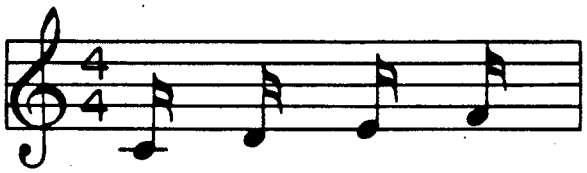
Figure 30:
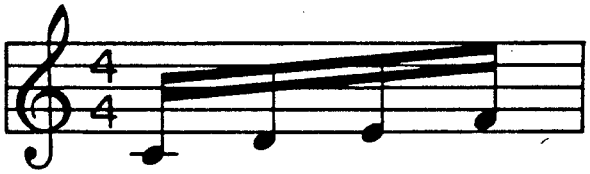

This will be described in detail below with reference to FIGS. 28 to 30.

Figure 28:
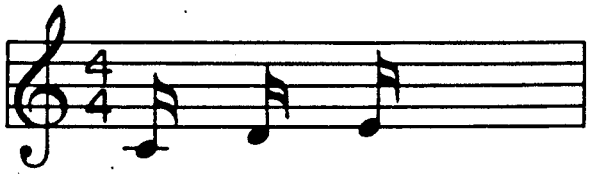
FIGS. 28 to 34 are views for explaining a principle of an arithmetic operation of automatic formation of a beam.

In FIG. 28, although one measure must include four quarter notes in a measure since a tune shown in FIG. 28 is in 4/4 time, the measure includes three sixteenth notes. A quarter note becomes the fundamental unit B of equation (1), and B=16 from FIG. 2. A total of note values is $b=4\times3=12$ since three sixteenth notes are present. In this state, another sixteenth note must be input, and a total of the note values is $b=12+4=16$. Therefore, if $N=1$, the equal sign of equation (1) is established. As a matter of course, an immediately preceding note is a flag note. Therefore, when note data are input as shown in FIG. 29, a necessary and sufficient condition of a beam is satisfied, and a beam is instructed to be drawn, as shown in FIG. 30.

Figure 31:
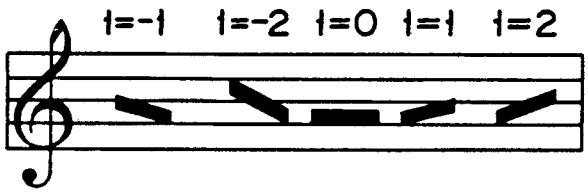
Figure 32:
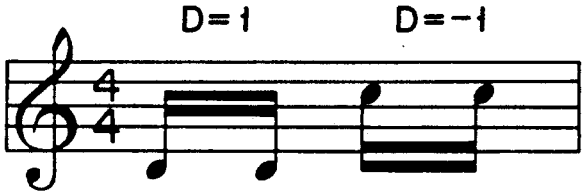
Figure 33:
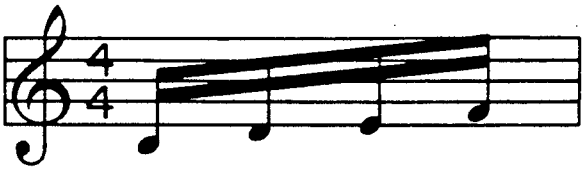
Figure 34:
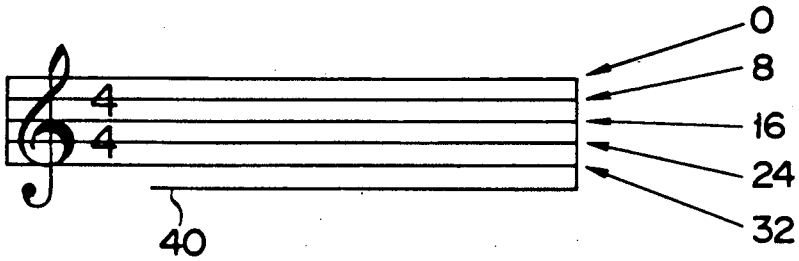

The principle of calculating a beam shape will be described below. The beam shape is established by three elements, i.e., an inclination (I), a direction (D), and a position (P). The inclination (I) is a visual sensitive element, and is unsuitable for determination by means of a calculation. Therefore, the inclination is determined by a correspondence table including five beam shapes and formed by an AI technique, as shown in FIG. 31. The direction (D) has two patterns, as shown in FIG. 32. One of these patterns satisfying the following inequalities is determined on the basis of a coordinate value, as shown in FIG. 34.

$$\sum_{i=1}^{n} \frac{pi}{n} > 16 : D = 1 \tag{2}$$

-continued $$\sum_{i=1}^{n} \frac{pi}{n} \leqq 16: D = -1 \quad (3)$$

where is the number of note heads below a beam, is the vertical position of a note head. This example will be examined using FIG. 33. When four note data are substituted in the above inequality, $$\sum_{i=1}^{n} \frac{pi}{n} = \frac{40}{4} + \frac{36}{4} + \frac{32}{4} + \frac{28}{4} = 34 > 16$$

Therefore, this corresponds to D=1, and notes are joined by a downward beam. The position (P) is calculated so that a minimum value of a length from a note head of each note to a beam is equal to 28 in the coordinate shown in FIG. 34.

Figure 35:
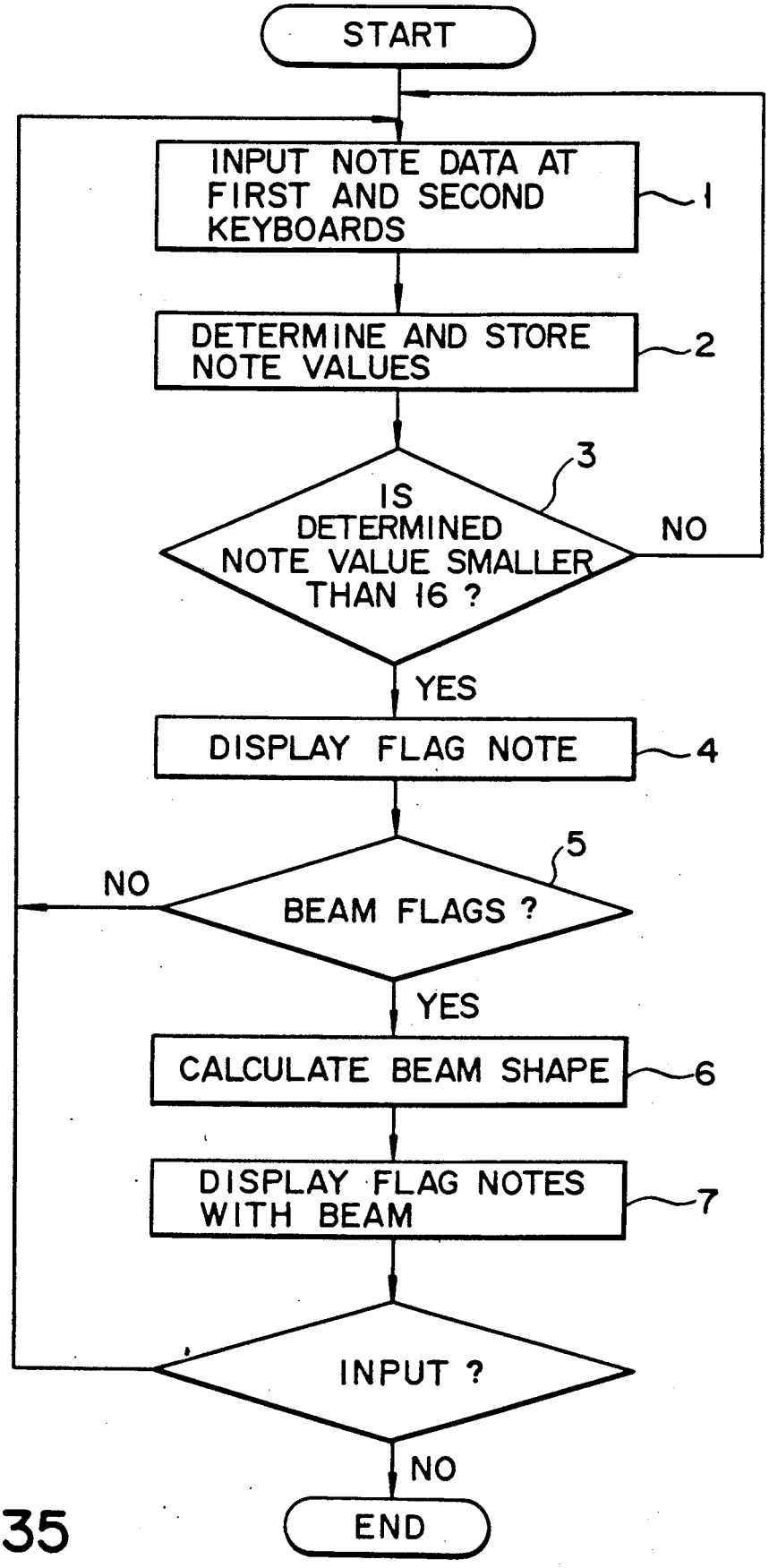
FIG. 35 is a flow chart for explaining arithmetic processing for automatic formation of the beam.

Arithmetic processing of automatic formation of a beam on the basis of the above principle will be described below with reference to the flow chart of FIG. 35. An operator first inputs note data by first and second keyboards (S1). Note value numbers of input note data are determined on the basis of FIG. 2 and are stored (S2). It is then checked if each determined note value number is smaller than 16 (S3). If it is determined that the note value number is smaller than 16, it can be determined that a corresponding note is a flag note such as an eighth note, sixteenth note, or the like.

Therefore, in the next step, the corresponding note data is displayed as a flag note (S4). A beam timing is determined based on whether or not the note data displayed as the flag note satisfies the necessary and sufficient condition that the equation (1) is satisfied on the basis of a time of an inputting tune and note value data of notes before and after the corresponding note and an immediately preceding note is a flag note (S5).

A beam shape is calculated on the basis of the three elements, i.e., the inclination (I), the direction (D), and the position (P), as described above (S6), and the flag notes joined by a beam are displayed in accordance with the calculation result (S7), thus completing the processing.

According to the present invention, in order to solve the conventional problem that a long time is required to correct flag notes of a musical score formed by a conventional method to beam notes or to instruct notes which should be joined by a beam in advance, a system for automatically determining notes which should be joined by a beam during input of musical score data, and quickly displaying a correct shape on the screen is provided, thereby shortening an input operation time of musical score data, and standardizing the beam shape to be a correct one.

We claim:

1. A musical score block copy forming apparatus comprising: first musical keyboard means including a full-scale key group in which keys corresponding to notes can be depressed simultaneously and a chromatic-scale key group in which keys corresponding to notes with accidentals can be depressed simultaneously, for inputting pitch data corresponding to a key operation; second musical keyboard means including a plurality of function keys and alphanumerical keys for inputting data by operating these keys as note duration data and other musical score constituting data; storage means for storing data input from said first and second musical keyboard means and data necessary for a musical score forming arithmetic operation; arithmetic processing means having a layout change function of performing a predetermined arithmetic operation for the data stored in said storage means and forming a musical score on the basis of the arithmetic result; display means for displaying the musical score formed by said arithmetic processing means on a screen; and output means, connected to said arithmetic processing means, for forming a block copy of the musical score displayed on said display means.

2. A musical score block copy forming apparatus according to claim 1, wherein said storage means includes, as structures, row data, staff data, note data, signature data, character data, word data, guitar chord data, and attack time data expressed on the musical score, each of said structures includes a storage address of another structure, and said arithmetic processing means has a function of simultaneously changing a layout of each of said when first and last attack times of each row are changed.

3. A musical score block copy forming apparatus according to claim 1, wherein said arithmetic processing means has a note assignment function of determining a layout of notes on a staff of the musical score.

4. A musical score block copy forming apparatus according to claim 1, wherein said arithmetic processing means has a word input function in which word data input by operating keys on said second musical keyboard means are positioned in correspondence with notes on a staff of the musical score, and an input state of the word data is displayed on said display means every time the word data is input.

5. A musical score block copy forming apparatus according to claim 1, wherein said arithmetic processing means has a function of positioning adjacent notes in a horizontal direction on the basis of a distance between adjacent words corresponding to the notes, and positioning words corresponding to notes in a vertical direction on the bases of a note determining a lowermost position of notes on a staff.

6. A musical score block copy forming apparatus comprising: first musical keyboard means including a full-scale key group in which keys corresponding to notes can be depressed simultaneously and a chromatic-scale key group in which keys corresponding to notes with accidentals can be depressed simultaneously, for inputting pitch data corresponding to a key operation; second musical keyboard means including a plurality of function keys and alphanumerical keys for inputting data by operating these keys as note duration data and other musical score constituting data; storage means for storing data input from said first and second musical keyboard means and data necessary for a musical score forming arithmetic operation; arithmetic processing means having a layout change function of performing a predetermined arithmetic operation for the data stored in said storage means and forming a musical score on the basis of the arithmetic result; display means for displaying the musical score formed by said arithmetic processing means on a screen; and output means, connected to said arithmetic processing means, for forming a block copy of the musical score displayed on said display means, wherein said arithmetic processing means has an assignment function in which a value (SP) necessary for note assignment is calculated on the basis of an inter-note distance and a minimum fixed value, a ratio (R=L/SP) of said value (SP) to an assignment distance (L) as a distance ;from a first bar line of a given row of the musical score to a last bar line of the given row is calculated, and the inter-note distance is updated until the ration (R) becomes almost 1.

7. A musical score block copy forming apparatus comprising: first musical keyboard means including a full-scale key group in which keys corresponding to notes can be depressed simultaneously and a chromatic-scale key group in which keys corresponding to notes with accidentals can be depressed simultaneously, for inputting pitch data corresponding to a key operation; second musical keyboard means including a plurality of function keys and alphanumerical keys for inputting data by operating these keys as note duration data and other musical score constituting data; storage means for storing data input from said first and second musical keyboard means and data necessary for a musical score forming arithmetic operation; arithmetic processing means having a layout change function of performing a predetermined arithmetic operation for the data stored in said storage means and forming a musical score on the basis of the arithmetic result; display means for displaying the musical score formed by said arithmetic processing means on a screen; and output means, connected to said arithmetic processing means, for forming a block copy of the musical score displayed on said display means, wherein said arithmetic processing means comprises note value determining means for determining a note value on the basis of input note data; beam timing determining means for determining a beam timing of the basis of a time of a tune being input and note value data of note data before and after input note data; and beam shape determining means for determining a beam shape on the basis of note value of notes of a note data group to be joined by a beam, a voice pitch and the number of notes, said arithmetic processing means having a function of displaying notes joined by a beam of the musical score displayed on a screen.

* * * * *